US005157935A

United States Patent [19]

Gregory

[11] Patent Number: 5,157,935

[45] Date of Patent: Oct. 27, 1992

[54] HOT GAS DEFROST SYSTEM FOR REFRIGERATION SYSTEMS AND APPARATUS THEREFOR

[75] Inventor: Charles Gregory, Burlington, Canada

[73] Assignee: Super S.E.E.R. Systems Inc., Ontario, Canada

[21] Appl. No.: 748,158

[22] Filed: Aug. 21, 1991

Related U.S. Application Data

[63] Continuation-in-part of Ser. No. 444,913, Dec. 4, 1989, Pat. No. 5,052,190.

[51] Int. Cl.[5] ..... F25B 47/00

[52] U.S. Cl. ..... 62/278; 62/513; 165/154; 165/908

[58] Field of Search ..... 62/81, 113, 196.4, 277, 62/278, 513, 324.5; 165/908, 154, 160, 161

[56] References Cited

U.S. PATENT DOCUMENTS

| | | | |
|---|---|---|---|
| 3,908,628 | 9/1975 | Lazaridis et al. | 165/154 X |
| 4,694,894 | 9/1987 | Kito et al. | 165/908 X |
| 4,798,058 | 1/1989 | Gregory | 165/154 X |
| 4,802,339 | 2/1989 | Gregory | 62/278 |

*Primary Examiner*—Harry B. Tanner
*Attorney, Agent, or Firm*—Rogers & Scott

[57] ABSTRACT

This invention provides a full flow vaporizer for use in a refrigeration system (which may be part of a heat pump) employing hot gas from the compressor to periodically defrost the cooling coil or coils. The vaporizer usually consists of three concentric circular cross-section tubes, the innermost tube receiving the fluid from the coil and being divided about midway along its length by a disc transverse barrier into first and third chambers. The cylindrical wall of the first chamber is provided with a plurality of holes directing the fluid forcefully radially outwards into a second chamber between the innermost and middle tubes and against the inner wall of the middle tube, which is heated by hot refrigerant gas passing in a fourth chamber between the middle and outermost tubes, the fluid then passing from the second chamber into the third chamber through a similar plurality of holes in the innermost tube cylindrical wall. The first and third chambers and the configuration of the holes leading from them into the second chamber are similar, so that the device is completely reversible and it is immaterial which end of the innermost tube is used as the inlet and which end is used as the outlet. The flow capacities of the passages and the bores are chosen to be in a specific range of flow capacities relative to one another, so that when not in use the vaporizer has no appreciable effect on the remainder of the system.

6 Claims, 3 Drawing Sheets

HOT GAS DEFROST SYSTEM FOR REFRIGERATION SYSTEMS AND APPARATUS THEREFOR

Cross-Reference to Related Application

This application is a continuation-in-part of my application Ser. No. 07/444,913 filed Dec. 4, 1989 for Apparatus for the Sensing of Refrigerant Temperatures, now U.S. Pat. No. 5,052,190.

FIELD OF THE INVENTION

This invention is concerned with improvements in or relating to refrigeration systems, and especially to hot gas defrost systems for refrigeration systems and heat pumps, and to apparatus for use in such hot gas defrost systems.

REVIEW OF THE PRIOR ART

The cooling coil of any refrigeration system will gradually collect frost or ice on its surface, due to the fact that water vapor in the air in contact with the coil condenses on it, and its temperature is usually low enough for the moisture to freeze on it. Ice is a relatively good heat insulator and if allowed to build up will initially lower the efficiency of the refrigerator, and eventually cause it to become ineffective. It is standard practice therefore in all but the simplest refrigerator or refrigerator installation to provide a system for automatically defrosting the coil, usually by arranging that at controlled intervals it is warmed to a temperature and for a period that will melt the ice, the resultant water being drained away. There are two principal methods currently in use for automatic defrost, namely electrical and hot gas.

In an electrical defrost system electric heating elements are provided in contact with the coil; at the required intervals the refrigeration system is stopped from operating and the elements are switched on to provide the necessary heat. In a hot gas defrost system the hot gas delivered from the compressor, that normally goes to an exterior coil to be cooled, is instead diverted into the cooling coil, again for a predetermined period found from experience to be satisfactory for the purpose. Both systems have their advantages and disadvantages.

An electrical system is relatively easy to design and install, but is more costly to implement and much less energy efficient than a hot gas system. A hot gas system is less costly to install but has been difficult to design; a particular problem of hot gas systems is that the compressor, the most expensive single component of the system, is easily damaged if it receives liquid refrigerant instead of gaseous refrigerant at its inlet. The heat exchange between the hot gas and the cold ice-laden coil will tend to liquefy the refrigerant, and the resultant droplets are difficult to remove from the gas, with consequent danger to the compressor.

A hot gas system delivers the heat directly to the tube of the coil and can therefore perform a comparable defrost with less energy expenditure than an equivalent electrical system. Moreover, the hot gas system effectively obtains its power from the compressor motor and requires only the addition of suitable flow valves and piping for its implementation; it is therefore the preferred system provided one is able to ensure that the expensive compressor is not damaged by liquid refrigerant.

Another type of apparatus incorporating a refrigeration system is a heat pump. It is usual practice with such systems for the outdoor coil to be air-cooled, owing to the expense of a ground-cooled system, and periodic defrosting of the outdoor coil is necessary when the system is in heating mode, because of the tendency of the coil to become ice-laden, especially when the outside temperature is low. "Reverse cycle" defrosting is by far the most common method of defrost employed, and in this method the unit is switched to the cooling mode and defrost occurs as hot gas from the compressor condenses in the outdoor coil.

There have been disclosed and claimed in my prior U.S. Pat. Nos. 4,798,058; 4,802,339 and 4,914,926, the disclosures of which are incorporated herein by this reference, a new liquid refrigerant vaporizer which is incorporated in a respective hot gas defrost system between the outlet of the condenser coil or coils and the compressor inlet and is supplied with hot gas from the compressor outlet, the vaporizer ensuring that any droplets in the gas emerging from the coil outlets are vaporized before they can reach the compressor inlet. These vaporizers have proven to be very effective and are now in commercial use.

A typical vaporiser as disclosed in my prior patents referred to above consists of three coaxial cylindrical tubes, all of approximately the same length. The innermost tube constitutes a first flow passage with an inlet at one end of the device that is connected to the condenser coil outlet to receive the refrigerant fluid exiting therefrom. The other end of this innermost tube is closed and its cylindrical wall is provided with a number of radially-extending apertures that direct the refrigerant fluid radially outwards from the first flow passage into a second flow passage formed between the innermost and middle tubes, so as to impinge against the inner wall of the middle tube, the fluid then passing from the second passage to an outlet at the other end of the device that is connected to the compressor inlet. A third flow passage surrounding the middle tube and formed between the middle and outermost tubes is provided with hot refrigerant gas from the compressor outlet and heats the wall of the middle tube so that the fluid that impinges thereon is fully vaporized. Since the device is usually inserted into a run of pipe, often as a retrofit to an existing system, the inlet and outlet are usually identical and, although the flow direction may be clearly marked on its exterior, there is still the possibility that it is connected in reverse, considerably reducing its effectiveness.

DEFINITION OF THE INVENTION

It is therefore an object of the present invention to provide a new liquid refrigerant vaporizer for use in a hot gas defrost system of a refrigeration system.

It is also an object to provide such a new vaporizer which is operative independently of the direction in which refrigerant fluid flows therethrough.

In accordance with the present invention there is provided a liquid refrigerant vaporizer for use in a refrigeration system employing hot refrigerant fluid to defrost a coil or coils thereof, the vaporizer comprising:

a first tubular member having an inlet/outlet at each end thereof, one of which inlet/outlets in operation is connected in the refrigeration system to receive refrigerant fluid exiting from a coil under defrost, and the other of which is connected in the refrigeration system to deliver the refrigerant fluid thereto, the member having at least approximately midway along its interior a transverse barrier dividing the interior into a first chamber connected to one inlet/outlet and a third chamber connected to the other inlet/outlet;

a second tubular member of heat conductive material surrounding the first tubular member to form a second annular chamber between them;

a first set of bores in the first chamber wall directing fluid from the first chamber into the second chamber radially outward to impinge against the inner surface of the second tubular member wall;

a second set of bores in the third chamber wall directing fluid from the third chamber into the second chamber radially outward to impinge against the inner surface of the second tubular member wall;

fluid that passes from the first chamber inlet/outlet into the first chamber and through the first set of bores into the second chamber thereafter moving in turbulent heat exchange contact with the inner surface of the second tubular member to the second set of bores, turning radially inward therethrough into the third chamber, and passing out of the third chamber inlet/outlet, while fluid that instead passes from the third chamber inlet/outlet into the third chamber and through the second set of bores into the second chamber thereafter moves in turbulent heat exchange contact with the inner surface of the second tubular member to the first set of bores, turns radially inward therethrough into the first chamber, and passes out of the first chamber inlet/outlet; and a third tubular member surrounding the second tubular member to form a third annular chamber between them, the third chamber having an inlet thereto for hot defrost refrigerant fluid to contact and heat the second chamber wall and the surface thereof against which the refrigerant fluid inpinges, and having an outlet therefrom for the defrost refrigerant fluid.

A refrigerant fluid flow restriction will usually be provided at or connected to the third chamber outlet for producing an increase in back pressure of the refrigerant fluid in the third chamber.

The vaporizor may be provided with an expansion chamber downstream of the restriction for re-evaporation of any liquid component passing through the flow restriction.

The invention also provides a hot gas defrost system and a refrigeration system employing such a refrigerant vaporizer.

DESCRIPTION OF THE DRAWINGS

Embodiments of the invention will now be described, by way of example, with reference to the accompanying schematic and diagrammatic drawings, wherein.

DESCRIPTION OF THE PREFERRED EMBODIMENTS

Figure 1:
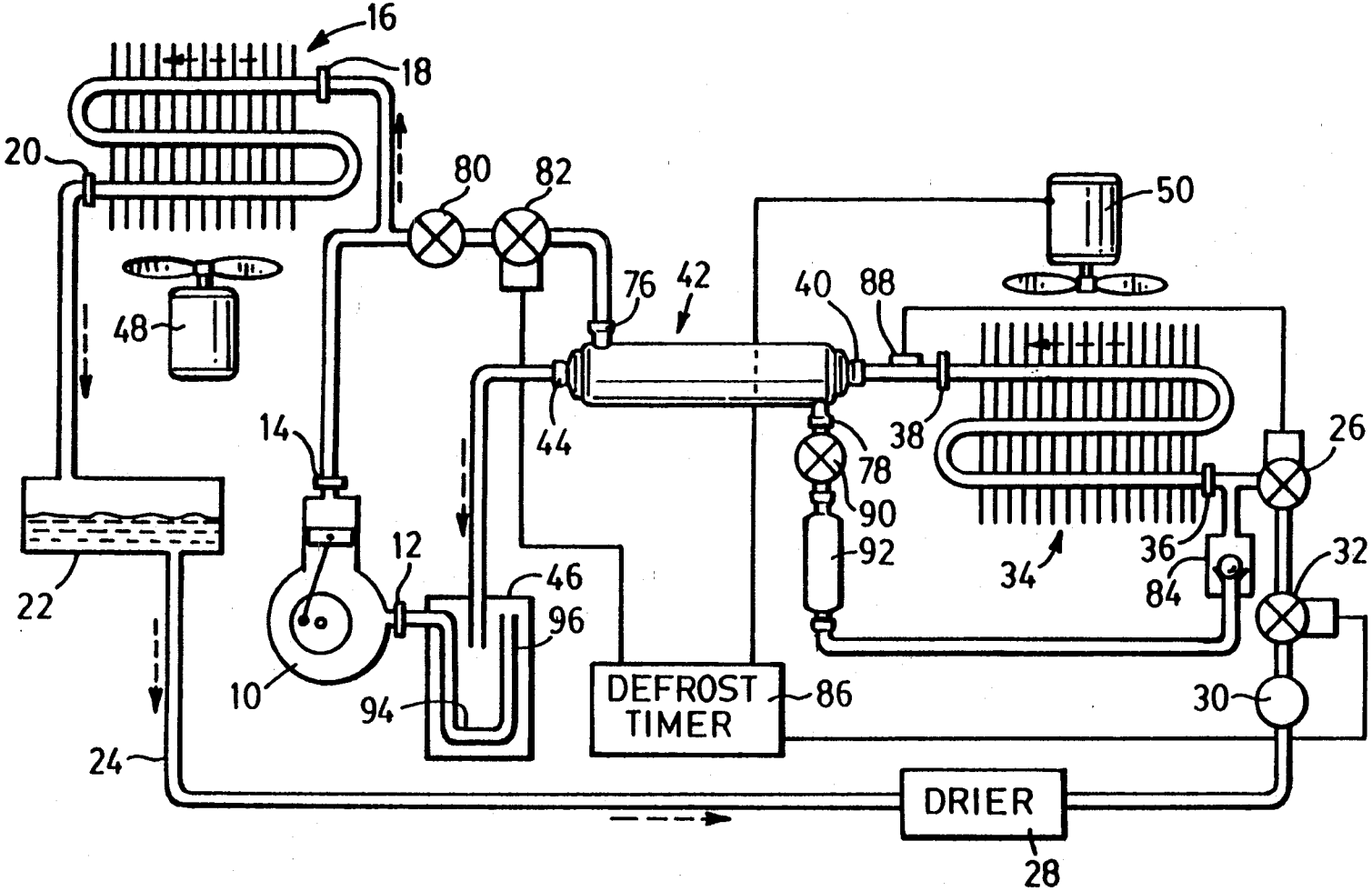
FIG. 1 is a schematic diagram of a refrigeration system embodying the invention.

FIG. 1 shows a refrigeration system which includes a compressor 10 having a suction inlet 12 and a high pressure outlet 14. A refrigerant condenser coil 16 has an inlet 18 connected to the high pressure outlet 14, and an outlet 20 connected to a vessel 22 which is adapted to collect liquid refrigerant. A refrigerant-conducting line 24 connects the vessel 22 to a thermostatic expansion valve 26 through a filter drier 28, a liquid indicator 30 and a solenoid-controlled liquid valve 32. The cooling coil 34 of the system has an inlet 36 connected to the expansion valve 26, and an outlet 38 connected to a refrigerant inlet 40 of a full flow liquid refrigerant vaporizer of the invention indicated generally by 42. The vaporizer 42 has an outlet 44 connected to the inlet of a suction line liquid accumulator 46, while the outlet of the accumulator 46 is connected to the suction inlet 12 of the compressor 10 to complete the circuit.

In its refrigeration mode of operation hot compressed gas from the compressor is condensed in coil 16, a fan 48 being provided to circulate air over and through the finned heat exchange structure of the coil. With the valves 26 and 32 open liquid refrigerant expands in the expansion valve 26 and passes into the coil 34 to cool the coil and therefore the adjacent space, air being circulated over the coil by a fan 50. All the expanded refrigerant vapor passes through the vaporizer 42, whose structure and function will be described in detail below, to return to the compressor 10 via the accumulator 46. This is of course a standard mode of operation for a refrigeration system, and this particular flow is illustrated by the broken line arrows.

The construction of the concentric tubular liquid refrigerant vaporizer 42 of FIGS. 1 and 3 will now be described with particular reference to FIG. 2. The device 42 is made of metal, preferably a high conductivity metal such as copper or brass, and consists of a first innermost cylindrical pipe 52, provided at least approximately at its middle point along its length with a transversely-extending circular disc 54 comprising a barrier extending over its entire cross-sectional area and dividing the pipe interior into two separate cylindrical chambers 56 and 58, called for convenience in terminology the first and third chambers. One end of this pipe constitutes the inlet 40, while the other end constitutes the outlet 44. The disc may be fastened into the interior of the pipe in any suitable manner, or alternatively, as illustrated, it may constitute a connecting member between two coaxial pipe pieces which together form the pipe 52; it may be noted that the barrier provided by the disc does not need to be absolutely gas tight between the first and third chambers. A second middle cylindrical pipe 62 of larger diameter surrounds the first innermost pipe 52 coaxial therewith and is sealed to the pipe 52 at both ends which turn radially inwards, thereby forming an annular cross-section second chamber 64 between the two pipes.

The fast flowing refrigerant fluid entering the innermost pipe 52 from the coil 38 impinges strongly against the transverse barrier 54 and immediately becomes extremely turbulent within the first chamber 56, far more so than the low velocity gas involved in the normal refrigeration cycle. The pipe 52 has a first set of plurality of holes 68 distributed uniformly along the part of its length within the first chamber 56, and also distributed uniformly around its periphery, these holes directing the turbulent refrigerant vapor from the chamber 56, together with any liquid entrained therein, forcefully into the second middle chamber 64 against the inner wall of the middle pipe 62. The pipe 52 has another set of a plurality of holes 70 similarly uniformly distributed along the part of its length within the second chamber 64 and around its periphery, which holes direct the highly turbulent vapor in the second chamber 64 back into the third chamber 58 and out of the outlet 44, the abrupt change of direction of the vapor required for its passage through the second set of holes 70 considerably increasing its turbulence in the third chamber 64.

A third outermost cylindrical pipe 72 coaxial with the pipes 52 and 62 encloses at least that portion of the middle pipe 62 adjacent the location of the holes 68 and 70, and has its radially inwardly-turned ends sealed to the pipe 62 so as to define a fourth outer annular cross-section chamber 74 surrounding the pipe 62. A hot gas inlet 76 is provided adjacent to one end of pipe 72 and an outlet 78 adjacent to the other end, so that hot refrigerant fluid from the compressor can be passed through the chamber 74 in heat exchange contact with as much as possible of the outer wall of the heat-conductive pipe 62, thereby heating the inner wall against which the refrigerant impinges when emerging from the holes 68 or 70, and against which the resultant turbulent fluid moves as it passes along the second chamber to exit through the other set of holes 70, resulting in complete and substantially immediate evaporation of any fine droplets therein. The fluid in the chamber 64, consisting now entirely of vapor, passes through the holes 70 into the third chamber 58 and exits through outlet 44 and the accumulator 46 to the compressor inlet 12.

The hot gas defrost system of the invention including the full flow vaporizer 42 has the fourth chamber inlet 76 connected to the hot gas outlet 14 of the compressor via a control valve 80 and a hot gas solenoid-operated valve 82, while its outlet 78 is connected via a check valve 84 to the junction of coil inlet 36 and expansion valve 26. The operation of the defrost system is under the control of a defrost timer 86 connected to the fan 50 and the valves 32 and 82. The operation of the expansion valve 26 is under the control of a thermostatic sensor 88. The remainder of the controls that are required for operation of the system will be apparent to those skilled in the art and do not require description herein for understanding of the present invention.

At predetermined intervals the defrost timer 86 initiates a defrost cycle by closing the solenoid valve 32 so that expanded cold refrigerant is no longer supplied to the coil 34; the timer deenergizes the fan 50 and opens hot gas solenoid valve 82, whereupon heated high pressure vapor from the compressor flows through the chamber 74 and heats the heat conductive pipe 62. The fluid exits at outlet 78 through a valve 90 constituting a controllable restriction and an expansion chamber 92 and passes through the check valve 75 to enter the coil 34. The fluid is still hot and gives up sensible and latent heat to the coil, warming it and melting any frost and ice accumulation, the gas becoming cooler by the consequent heat exchange. The fluid moves through the coil at relatively high velocity and only part of it condenses to liquid, which is however completely revaporized in the vaporizer, as described above. At the end of the timed defrost period the timer 86 deenergizes and closes the hot gas valve 82, opens valve 32 and reenergizes the fan motor 50, so that the system is again in its normal cooling mode.

The device will allow refrigerant to flow equally well in either direction, so that it is immaterial which end is used as the inlet, and which is used as the outlet, exactly the same effective heat exchange action being obtained if the device is reversed. Although the device is illustrated in horizontal attitude its operation is independent of attitude and it can be disposed in any convenient location, unlike the accumulator 46 which must be disposed upright as shown. It may be noted that the accumulator 46 is not required for the hot gas defrost cycle and its sole purpose is to try to protect the compressor in case of a liquid refrigerant flow control malfunction. As is usual, any lubricant in the system that collects in the accumulator bleeds back into the circuit through bleed hole 94 in return pipe 96.

The dimensions of the three pipes 52, 62 and 72 and of the apertures 68 and 70 relative to one another are important for the successful functioning of the vaporizer in accordance with the invention, as is described in my prior patents referred to above. Thus, the pipe 52 preferably is of at least the same internal diameter as the remainder of the suction line to the compressor, so that it is of the same flow cross-sectional area and capacity. The number and size of the holes 68 and 70 are chosen so that the flow cross-section area provided by all the holes together is not less than about 0.5 of the cross-section area of the pipe 52 and preferably is about equal or slightly larger than that area. The total cross-section area of the holes need not be greater than about 1.5 times the pipe cross-section area and increasing the ratio beyond this value has no corresponding increased beneficial effect. Moreover, each individual hole should not be too large and if a larger flow area is needed it is preferred to provide this by increasing the number of holes. As described above, the purpose of these holes is to direct the flow of refrigerant fluid radially outwards into impingement contact with the inner wall of the pipe 62, and this purpose may not be fully achieved if the holes are too large. Each set of holes is uniformly distributed along and around its respective portion of the pipe 52 to maximize the area of the adjacent portion of the wall of pipe 62 that is contacted by the fluid issuing from the holes.

It is also important that the flow cross-section area of the second annular chamber 64 be not less than about 0.5 of the corresponding flow area of the pipe 52, and again preferably they are about equal, with the possibility of that of chamber 64 being greater than that of pipe 52, but not too much greater, the preferred maximum again being about 1.5 times. The diameter of the pipe 72 is made sufficiently greater than that of the pipe 62 that the cross-sectional flow area of the annular space 74 is not less than that of the hot gas discharge line from the pump outlet 14 to the inlet 76, and can be somewhat larger, to the same extent of about 1.5 times. The inlet 76 to the chamber 74 and the outlet 78 are of course of sufficient size not to throttle the flow of fluid therethrough.

It will be understood by those skilled in the art that if the vaporizer is constructed in this manner then during normal cooling operation of the system it will appear to the remainder of the system as nothing more than another piece of the suction line, or at most a minor constriction or expansion of insufficient change in flow capacity to change the characteristics of the system significantly. The system can therefore be designed without regard to this particular flow characteristic of the vaporizer. Moreover, it will be seen that it can be incorporated by retrofitting into the piping of an existing refrigeration system without causing any unacceptable change in the flow characteristics of the system.

The orifice or flow restrictor constituted by the valve 90 is surprisingly effective in providing consistent defrosting and self-regulation of the process, the latter avoiding compressor overload and consequent stress, the valve being adjusted during operation to provide the required value of back pressure. For a predesigned and prebuilt system it can instead be a fixed orifice. The operation of the vaporizer and the functions of the restrictor valve 90 and the subsequent expansion chamber 92 are fully described in my prior patents referred to above, to which reference can be made.

In a specific embodiment intended for a refrigeration system employing a 7.5–10 horsepower motor the entire vaporizer device had a length of about 65 cm (26 in.). The inner pipe 52 was copper of 3.4 cm (1.325 in.) outside diameter (O.D.); the middle pipe 62 was also copper of 5.3 cm (2.125 in.) O.D . . The pipe 52 was provided with two separate sets of 48 uniformly distributed holes each of 4.8 mm (0.1875 in.) diameter for a total of 96 holes. The outermost pipe 72 had a length of 60 cm (24 ins) and an O.D. of 6.56 cm (2.625 ins), while the hot gas line had a diameter of 2.18 cm (0.875 in).

Figure 2:
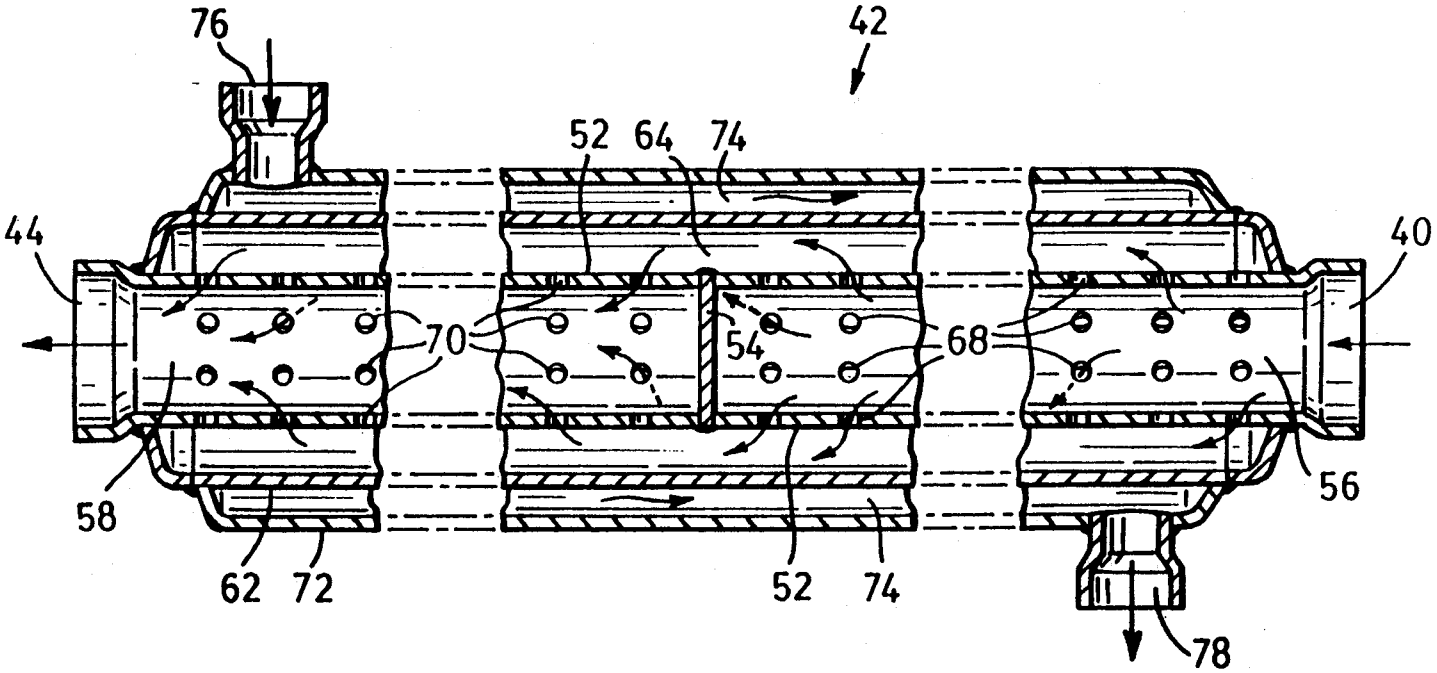
FIG. 2 is a longitudinal cross-section through a concentric tubular full flow liquid refrigerant vaporizer of the invention.
Figure 3:
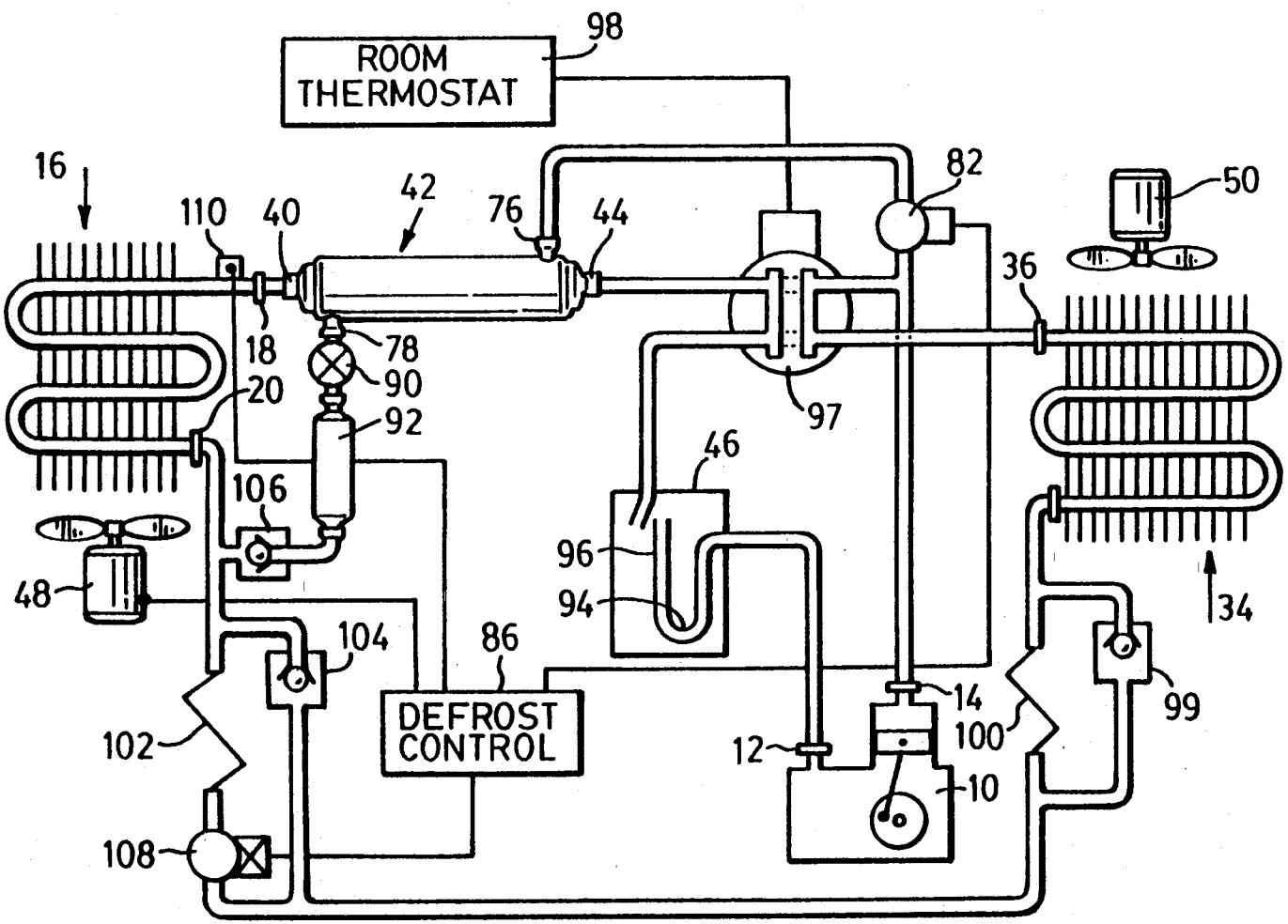
FIG. 3 is a schematic diagram of a heat pump system embodying the invention and employing the vaporizer of FIG. 2.

Unexpectedly I have found that a device as specifically described, employing three successive chambers with two abrupt changes of direction through respective sets of holes, is just as efficient in providing for vaporization of the fluid refrigerant as my prior device, as described and illustrated for example in the respective FIGS. 2 of my above-mentioned prior U.S. Patents, which employs two successive chambers with only a single abrupt change of direction through a single set of holes. It is a substantial commercial advantage of this embodiment that the installer is able to install it without having to consider the direction of refrigerant flow through the device. It was found with the prior art devices that there was an unacceptable decrease in performance if it has been installed reversed, but this cannot happen with the devices of the present invention.

The invention is of course also applicable to domestic refrigerators which hitherto have normally used electric defrost circuits, but would be much more energy efficient if hot gas defrost could be used. The invention is also particularly applicable to heat pump systems and FIG. 3 shows such a system in heating mode, the system being shifted to air conditioning mode by movement of a solenoid-operated change-over valve 97 from the configuration shown in solid lines to that shown in broken lines. Coil 16 is the outdoor coil which in heating mode is cooled and in air conditioning mode is heated, while coil 34 is the inside coil with which the reverse occurs. When the outside temperature falls below about 8° C. (45° F.) the temperature of coil 16 in heating mode will be cold enough to condense and freeze moisture in the air circulated over it by fan 48, and if this frost is allowed to build up will quickly reduce the unit's efficiency. The most common method of defrosting is simply to reverse the cycle to air conditioning mode by operation of change-over valve 97, every 30 to 90 minutes for a period of from 2 to 10 minutes, depending upon the severity of the icing conditions. This valve is normally under the control of room thermostat 98 which causes it to switch from one mode to the other for heating or cooling as required.

In heating mode the hot high pressure vapor produced by the compressor 10 is fed via the valve 97 to the indoor coil 34 while hot gas solenoid valve 82 is closed. The vapor condenses in the coil to heat the air passed over the coil by the fan 50, and the condensed refrigerant passes through check valve 99, by-passing expansion device 100 which is illustrated as being a capillary line, but instead can be an orifice or expansion valve of any known kind. The liquid however must pass through similar expansion device 102 and the resultant expanded cooled vapor passes to the outdoor coil 16 to be heated and vaporized by the ambient air. Check valves 104 and 106 ensure respectively that the device 102 is not by-passed, and that the expanded vapor cannot enter the vaporization device 42. The vaporized refrigerant from the coil 16 passes through the device 42 as though it were simply an open part of the compressor suction line tubing, and then passes through valve 97 and the accumulator 46 to the compressor inlet 12 to complete the cycle. The controls required for the operation of the system will be apparent to those skilled in the art and a description thereof is not needed herein for a full explanation of the present invention.

A defrost cycle is initiated by the defrost control 86 without any change required in the position of valve 97, the control switching off the fan motor 48, so that the coil 16 is no longer cooled by the fan, and opening the hot gas valve 82 to admit the hot high pressure refrigerant vapor from the compressor to the vaporizer chamber 74, as well as to the indoor coil 34. After warming the pipe 62 the hot gas passes through restrictor valve orifice 90, expansion chamber 92 and check valve 106 to enter the coil 16 and perform its defrost function, as described above with reference to FIGS. 1 and 2. The direct pressure of the hot gas at the end of the expansion device 102 blocks the flow from the coil 34 so that the refrigerant is trapped in the line between the two restrictions.

A liquid line solenoid 108 is installed ahead of the expansion device 102 and is closed during the defrost period to prevent the liquid refrigerant in the line expanding into the outside coil 16, which would reduce the defrost efficiency. The operation of the device 42, the restrictor 90 and the expansion chamber 92 are exactly as described above, the gas from the outlet 44 passing through valve 97 and accumulator 46 to the suction inlet 12 of the compressor. After a predetermined period of time set by the defrost control 86, with or without an override temperature control provided by a thermostat 110 adjacent to the coil outlet 18, whichever arrangement is preferred to ensure that defrosting is complete, the valve 82 is closed to stop the direct flow of hot gas to the vaporizer 42 and coil 16. The solenoid valve 108 is opened and the fan motor 48 is restarted. The system then returns to its normal heating cycle.

The vaporizer 42 is inoperative when the system is in air conditioning or cooling mode serving as part of the compressor discharge line due to it being able to pass refrigerant flow equally in either direction and description of the cycle in that mode is therefore not required, except to point out that the expansion device 100 is now operative while the device 102 is by-passed by check valve 104.

I claim:

1. A liquid refrigerant vaporizer for use in a refrigeration system employing hot refrigerant fluid to defrost a coil or coils thereof, the vaporizer comprising:

a first tubular member having an inlet/outlet at each end thereof, one of which inlet/outlets in operation is connected in the refrigeration system to receive refrigerant fluid exiting from a coil under defrost, and the other of which is connected in the refrigeration system to deliver the refrigerant fluid thereto, the member having at least approximately midway along its interior a transverse barrier dividing the interior into a first chamber connected to one inlet/outlet and a third chamber connected to the other inlet/outlet;

a second tubular member of heat conductive material surrounding the first tubular member to form a second annular chamber between them;

a first set of bores in the first chamber wall directing fluid from the first chamber into the second chamber radially outward to impinge against the inner surface of the second tubular member wall;

a second set of bores in the third chamber wall directing fluid from the third chamber into the second chamber radially outward to impinge against the inner surface of the second tubular member wall;

fluid that passes from the first chamber inlet/outlet into the first chamber and through the first set of bores into the second chamber thereafter moving in turbulent heat exchange contact with the inner surface of the second tubular member to the second set of bores, turning radially inward therethrough into the third chamber, and passing out of the third chamber inlet/outlet, while fluid that instead passes from the third chamber inlet/outlet into the third chamber and through the second set of bores into the second chamber thereafter moves in turbulent heat exchange contact with the inner surface of the second tubular member to the first set of bores, turns radially inward therethrough into the first chamber, and passes out of the first chamber inlet/-outlet; and a third tubular member surrounding the second tubular member to form a third annular chamber between them, the third chamber having an inlet thereto for hot defrost refrigerant fluid to contact and heat the second chamber wall and the surface thereof against which the refrigerant fluid impinges, and having an outlet therefrom for the defrost refrigerant fluid.

2. A vaporizer is claimed in claim 1, wherein the said first, second and third tubular members are of cylindrical configuration formed by tubes disposed one within the other and coaxial with one another.

3. A hot refrigerant fluid defrost system for use in a refrigeration system for defrost of a coil or coils thereof, the system comprising:

a controllable flow valve adapted for connection to the outlet of a compressor pump to receive hot compressed refrigerant fluid therefrom;

a coil to be defrosted having an inlet and an outlet;

a liquid refrigerant vaporizer connected to the coil outlet for vaporizing liquid fluid issuing from the outlet to prevent its delivery to the compressor inlet;

the vaporizer comprising:

a first tubular member having an inlet/outlet at each end thereof, one of which inlet/outlets in operation is connected in the refrigeration system to receive refrigerant fluid exiting from a coil under defrost, and the other of which is connected in the refrigeration system to deliver the refrigerant fluid thereto, the member having at least approximately midway along its interior a transverse barrier dividing the interior into a first chamber connected to one inlet/outlet and a third chamber connected to the other inlet/outlet;

a second tubular member of heat conductive material surrounding the first tubular member to form a second annular chamber between them;

a first set of bores in the first chamber wall directing fluid from the first chamber into the second chamber radially outward to impinge against the inner surface of the second tubular member wall;

a second set of bores in the third chamber wall directing fluid from the third chamber into the second chamber radially outward to impinge against the inner surface of the second tubular member wall;

fluid that passes from the first chamber inlet/outlet into the first chamber and through the first set of bores into the second chamber thereafter moving in turbulent heat exchange contact with the inner surface of the second tubular member to the second set of bores, turning radially inward therethrough into the third chamber, and passing out of the third chamber inlet/outlet, while fluid that instead passes from the third chamber inlet/outlet into the third chamber and through the second set of bores into the second chamber thereafter moves in turbulent heat exchange contact with the inner surface of the second tubular member to the first set of bores, turns radially inward therethrough into the first chamber, and passes out of the first chamber inlet/-outlet; and a third tubular member surrounding the second tubular member to form a third annular chamber between them, the third chamber having an inlet thereto for hot defrost refrigerant fluid to contact and heat the second chamber wall and the surface thereof against which the refrigerant fluid impinges, and having an outlet therefrom for the defrost refrigerant fluid;

the inlet to the third chamber being connected to the said controllable flow valve for the flow therethrough to be controlled by the valve, and the outlet from the third chamber being connected to the coil inlet for delivery of the fluid thereto.

4. A hot refrigerant fluid defrost system as claimed in claim 3, wherein the said first, second and third tubular members are of cylindrical configuration formed by tubes disposed one within the other and coaxial with one another.

5. A refrigeration system comprising:

a refrigerant compressor;

a cooling coil having an inlet and an outlet;

an expansion device for expanding and cooling refrigerant connected between the compressor and the cooling coil inlet;

a controllable defrost control valve connected to the compressor outlet to receive hot compressed refrigerant fluid therefrom;

a liquid refrigerant vaporizer connected to the coil for vaporizing liquid fluid issuing from the coil outlet to prevent its delivery to the compressor inlet;

the vaporizer comprising:

a first tubular member having an inlet/outlet at each end thereof, one of which inlet/outlets in operation is connected in the refrigeration system to receive refrigerant fluid exiting from a coil under defrost, and the other of which is connected in the refrigeration system to deliver the refrigerant fluid thereto, the member having at least approximately midway along its interior a transverse barrier dividing the interior into a first chamber connected to one inlet/outlet and a third chamber connected to the other inlet/outlet;

a second tubular member of heat conductive material surrounding the first tubular member to form a second annular chamber between them;

a first set of bores in the first chamber wall directing fluid from the first chamber into the second chamber radially outward to impinge against the inner surface of the second tubular member wall;

a second set of bores in the third chamber wall directing fluid from the third chamber into the second chamber radially outward to impinge against the inner surface of the second tubular member wall;

fluid that passes from the first chamber inlet/outlet into the first chamber and through the first set of bores into the second chamber thereafter moving in turbulent heat exchange contact with the inner surface of the second tubular member to the second set of bores, turning radially inward therethrough into the third chamber, and passing out of the third chamber inlet/outlet, while fluid that instead passes from the third chamber inlet/outlet into the third chamber and through the second set of bores into the second chamber thereafter moves in turbulent heat exchange contact with the inner surface of the second tubular member to the first set of bores, turns radially inward therethrough into the first chamber, and passes out of the first chamber inlet/outlet; and a third tubular member surrounding the second tubular member to form a third annular chamber between them, the third chamber having an inlet thereto for hot defrost refrigerant fluid to contact and heat the second chamber wall and the surface thereof against which the refrigerant fluid impinges, and having an outlet therefrom for the defrost refrigerant fluid;

the inlet to the third chamber being connected to the said controllable flow valve for the flow therethrough to be controlled by the valve, and the outlet from the third chamber being connected to the coil inlet for delivery of the fluid thereto.

6. A refrigeration system as claimed in claim 5, wherein the said first, second and third tubular members are of cylindrical configuration formed by tubes disposed one within the other and coaxial with one another.

* * * * *